US005911406A

United States Patent [19]

Winefordner et al.

[11] Patent Number: 5,911,406

[45] **Date of Patent: *Jun. 15, 1999**

[54] LIQUID DISPENSING AND ITEM STORAGE SYSTEM WITH ORALLY ACTIVATED VALVE

[76] Inventors: Carl Winefordner; Frank Hermansen, both of 181 Costa Mesa St., Costa Mesa, Calif. 92627; Jean-Claude Olivieri, 27871 Calle San Remo, San Juan Capistrano, Calif. 92675

[ * ] Notice: This patent issued on a continued prosecution application filed under 37 CFR 1.53(d), and is subject to the twenty year patent term provisions of 35 U.S.C. 154(a)(2).

[21] Appl. No.: 08/529,080

[22] Filed: Sep. 15, 1995

[51] Int. Cl.[6] ..... F16K 31/00

[52] U.S. Cl. ..... 251/339; 222/175

[58] Field of Search ..... 251/339; 222/175, 222/518, 559; 239/33, 569, 152, 153

[56] References Cited

U.S. PATENT DOCUMENTS

| | | | |
|---|---|---|---|
| 2,815,981 | 12/1957 | Nonnamaker | 239/33 |
| 3,646,955 | 3/1972 | Olde | 251/339 |
| 3,822,720 | 7/1974 | Souza . | |
| 4,090,650 | 5/1978 | Gotta . | |
| 4,095,812 | 6/1978 | Rowe . | |
| 4,402,343 | 9/1983 | Thompson | 251/339 |
| 4,629,098 | 12/1986 | Eger . | |
| 4,739,905 | 4/1988 | Nelson . | |
| 4,776,495 | 10/1988 | Vignot . | |
| 4,852,781 | 8/1989 | Shurnick et al. . | |
| 4,941,598 | 7/1990 | Lambelet, Jr. et al. . | |
| 4,948,023 | 8/1990 | Tripp . | |
| 5,060,833 | 10/1991 | Edison et al. . | |
| 5,065,700 | 11/1991 | Cross | 251/339 |
| 5,085,349 | 2/1992 | Fawcett . | |
| 5,104,016 | 4/1992 | Runkel | 222/175 |

*Primary Examiner*—John Rivell
*Assistant Examiner*—Ramyar Farid
*Attorney, Agent, or Firm*—Leonard Tachner

[57] ABSTRACT

A combined liquid dispensing and item storage system with an orally activated valve. The system comprises a collapsible container for liquid that incorporates integrated auxiliary expandable storage pockets. The system is removably secured at a location on the back between the shoulders. An externally accessible fill port is covered by a flexible embossed foam panel held in place by shoulder straps and which panel protects against the discomfort of the fill port cap against the back, insulates the liquid, and provides air channels to vent and dissipate body heat. A length of flexible tubing for delivering the liquid is attached to the collapsible container, then routed through a slot in the auxiliary expandable storage pocket, over either shoulder, and held near the mouth by adjustable orienting holders attached to the shoulder straps. The orally activated valve is located at the end of the flexible tubing which delivers the liquid from the flexible tubing to the mouth. The valve device is in the form of an elongated hollow structure having an open inlet end opposed to a closed outlet end forming a fluid supply chamber between the open inlet and closed outlet end. The open inlet end is connected to the flexible tubing in order to obtain liquid from the collapsible container for the supply chamber. The closed outlet end embodies a spring biased valve plunger which can be depressed by tongue or teeth to move the valve plunger into an open configuration to enable liquid flow therethrough.

2 Claims, 5 Drawing Sheets

LIQUID DISPENSING AND ITEM STORAGE SYSTEM WITH ORALLY ACTIVATED VALVE

BACKGROUND OF THE INVENTION

1. Field of the Invention

The rate at which bodily liquids are released into the atmosphere increases with ambient temperature, humidity, wind velocity, wearing apparel, and physical exersion. While exercising vigorously, an athlete loses an average of one liter of bodily liquid per hour which can lead to dehydration if not replaced by ingested liquid. It is preferred that liquids be ingested at substantially the same rate at which they are dissipated in order to ensure good health, maximize physical performance and to avoid the dangers of heat prostration.

While bicyclists, long distance runners, hikers, and other athletes require continuous replacement of bodily liquids, this is difficult to achieve because of the complexities involved in simultaneously drinking from a container while performing the athletic functions such as pedaling a bicycle or maintaining timing, rhythm and balance.

When performing certain outdoor activities such as bicycling or hiking, it is desirable to carry items such as sunscreen, an emergency medical kit, a jacket, identification, and tools as well as liquids. Depending on the duration and type of activity, the need for equipment varies. At certain times it may be that only liquids are desired. It would be desirable for a liquid dispensing system to be compact and streamline when carrying only liquids yet have the ability to expand to carry numerous miscellaneous items as needed.

Some items to be carried may be valuable; others such as lip balm are small and difficult to find if not placed in a small identifiable pocket, while others such as a jacket are bulky. It would be advantageous for a liquid dispensing system to have small pockets to store certain items and at least one large pocket for larger items and yet this usually leads to a bulky and cluttered arragement. It would also be advantageous for secure storage of valuable items. Small pockets incorporated within a large pocket, would accomplish these advantages by providing space for small and large items in a neat, compact arrangement, while incorporating multiple closures for security.

2. Prior Art

Existing liquid dispensing systems that use a collapsible container for holding liquid are constructed such that the collapsible container is independent of the insulating pouch which is independent of a storage pouch that incorporates pockets for storage. These systems are bulky, cumbersome, and expensive because they are, in essence, comprised of a bag within a bag within a bag. In order to fill the bladder with liquid, one must open the outer bag or bags and remove the bladder. The full bladder must then be pushed into the insulating pouch, a difficult and cumbersome task, especially if an additional outer storage bag is full of extraneous but necessary items. It would be advantageous to have an integrated liquid dispensing and storage system such that it is one complete unit having an externally accessible fill port.

The weight of the liquid dispensing and storage system is of primary importance. Existing liquid dispensing systems utilizing multi-bag construction are relatively heavy. It would be advantageous to have a liquid dispensing and storage system that is integrated such that it is one complete unit reducing construction material usage for weight reduction while maintaining the benefits of insulation and storage.

Because the construction of existing liquid dispensing systems with storage capabilities requires that the internal bladder be removed from the outer bag or bags for filling, the flexible tubing that connects the bladder to the mouthpiece must be separable from the outer bag or bags and cannot be semipermanently affixed to the shoulder straps. This causes inconvenience when donning the system because the unaffixed flexible tubing becomes entangled with the shoulder straps or hangs behind the user, making it difficult to reach behind the back to retrieve the flexible tubing. It would be advantageous to have a liquid dispensing system with storage with flexible tubing that can be semipermanently affixed to the shoulder straps, and which can remain affixed when filling the collapsible container and when donning the system.

The orienting holders on existing liquid dispensing systems with storage capabilities are either fixed in place on the shoulder strap, making them unadjustable, or utilize a clip which requires the use of both hands in order to fix in place or adjust such systems. It would be desirable for a liquid dispensing system to have orienting holders which are easily adjustable to different positions along the shoulder strap utilizing only one hand.

Existing liquid dispensing systems that use a collapsible container for holding the liquid, incorporate fill ports which are smooth on the inner wall allowing no space between the inner wall of the fill port and the opposite flexible inner wall when the collapsible container is empty. This lack of space makes filling the container with liquid difficult because while holding the fill port under the flow of liquid, the collapsible container naturally folds due to gravity which effectively closes the fill port. It would be desirable for the fill port on a liquid dispensing system to have multiple support legs on the inner surface holding the opposite flexible inner wall of the collapsible container slightly distant from the fill port so that liquid can naturally flow into the container during the filling operation.

Existing liquid dispensing systems retain body heat in the area of the back abutting the container because existing materials, used to insulate the liquid within the collapsible container, prevent body heat from dissipating freely in the area of contact. It would be desirable to have a panel with embossed channels which insulate the liquid within the collapsible container while allowing air to vent between the insulating panel and the user's back.

Athletes must ingest liquids while breathing rapidly and deeply. It would be advantageous to be able to frequently swallow small amounts of liquid intermittently between breaths, allowing maximum liquid intake without sacrificing oxygen intake. It would be desirable to have an orally activated valve device that can be easily held in the teeth without activating the valve in order to be able to breathe heavily between instances of liquid ingestion without liquid dripping from the valve. This would allow repetitive liquid intake and breathing without unwanted liquid flow interfering with breathing.

When the mouth is in a sucking configuration, the tongue naturally thrusts forward to prevent the object from entering too far into the mouth. It would be desirable for a drinking device to have an orally activated valve that utilizes the natural thrusting of the tongue to depress an activating member on the front of the device.

Individuals will have different preferences for oral activation of a drinking device depending on physical position, situation or personal biases. For example, the body of a cyclist on a road bike is oriented horizontally with the face angled vertically, while the body and face of a mountain biker or hiker are both vertical, and the body of a snow skier is vertical with the face angled horizontally. Different head to body positions change the angle of the valve device in the mouth, assuming the flexible tubing is of a fixed length. It would be desirable to have an orally activated valve on a liquid dispensing system which allows activation with various techniques utilizing the tongue and/or teeth to accommodate differing physical positions, situations and preferences.

A valve device which easily dislodges from the flexible tubing could be ingested into the lungs or passageways associated with the lungs of hyperventilating athletes such as runners or cyclists. A unitary resilient valve device as described in the prior art, for example, easily dislodges from the flexible tubing because the material used cannot be both soft and resilient enough to function as a bite valve, yet be stiff enough to resist accidental dislodgment. It would be desirable for a valve device for oral use to be securely connected to the flexible tubing in order to avoid the possibility of the valve device being ingested by the user.

The following patents are deemed to be relvant to the present invention to varying degrees but without precluding the patentability thereof:

U.S. Pat. No. 3,822,720 Souza

U.S. Pat. No. 4,090,650 Gotta

U.S. Pat. No. 4,095,812 Rowe

U.S. Pat. No. 4,629,098 Eger

U.S. Pat. No. 4,739,905 Nelson

U.S. Pat. No. 4,776,495 Vignot

U.S. Pat. No. 4,852,781 Shurnick et al

U.S. Pat. No. 4,941,598 Lainbelet, Jr. et al

U.S. Pat. No. 4,948,023 Tripp

U.S. Pat. No. 5,060,833 Edison et al

U.S. Pat. No. 5,085,349 Fawcett

SUMMARY OF THE INVENTION

The present invention comprises a novel liquid dispensing system with an orally activated valve device that integrates a collapsible container with straps for removably securing the system at a location on the back between the shoulders and integrates auxiliary expandable storage pockets. The invention has an externally accessible fill port that is covered by a flexible flap which is held in place by shoulder straps and insulates the user from feeling the fill port cap against his or her back while wearing the system. Flexible tubing is routed from an elbow attached to the collapsible container, then under an auxiliary pocket panel and out through a slot over either shoulder and is held conveniently near the user's mouth by an adjustable ring attached to the shoulder strap. An embossed foam panel insulates the liquid and provides air channels to vent and dissipate body heat.

The present invention provides a liquid dispensing system with an orally activated valve device that avoids the aforementioned drawbacks of the prior art. Moreover, the orally activated valve of the present invention can be arranged to provide a simple pump system that can be manipulated by the mouth or hand to move liquid from one location to another.

This invention includes a novel device which is in the form of an elongated body member that provides a hollow structure having an open inlet end opposed to a closed outlet end. A fluid supply chamber is formed between the inlet and outlet ends. The open inlet end is connected to a length of tubing to supply fluid flow from a suitable container to the supply chamber, while the closed outlet end provides a valve plunger closure which can be depressed or deformed into an opened configuration to enable fluid flow to occur therethrough.

More specifically, this invention relates to a valve apparatus of a size and configuration to be comfortably received within a person's mouth for use in a system for delivering liquid from a container to the valve apparatus located in a person's mouth. The valve is in the form of an elongated body member that forms a hollow structure having an open inlet and opposed a closed outlet end, a fluid supply chamber being formed between the inlet and outlet ends. The open inlet end can be connected to a length of tubing to supply fluid flow from the container to the supply chamber, while the close outlet end provides a valve plunger closure member that normally precludes fluid flow therethrough, and which can be depressed with one's tongue or teeth into an opened configuration to enable fluid flow to occur therethrough and into a person's mouth.

The container provides a liquid supply and is connected to the tubing end opposed to the valve such that the tubing and container provide a fluid source for the supply chamber of the valve. When the valve plunger is depressed to the open position, fluid flows from the supply chamber and through the valve where the contents of the chamber are made available to be ingested.

The valve body is placed in one's mouth so that the valve plunger can be depressed by one's tongue or teeth and thereby open the valve in proportion to the force exerted thereagainst and thereby enable flow to occur from the supply chamber. When the valve is held in one's mouth and the supply chamber is connected to an elevated source of liquid, the liquid can be metered into one's mouth whenever desired by depressing the valve plunger thereby opening the valve and allowing liquid to flow into one's mouth. Under the same circumstances but with the supply chamber connected to a non-elevated source, the liquid can be metered into one's mouth whenever desired by depressing the valve plunger to open the valve and sucking at various vacuum levels causing the liquid to flow into one's mouth.

After the person is finished drinking, they can, if desired, then drop the valve body from their mouth or "spit" it out and liquid will not drip from the valve outlet unless the valve body is purposely and vigorously shaken.

The round configuration of the valve body and valve plunger enables the apparatus to be held in any position without regard for orientation in one's mouth and thereby meter fluid into the body with very little conscious effort.

OBJECTS OF THE INVENTION

An object of the present invention is the provision of a collapsible liquid container that integrates straps for removably securing the container at a location between the shoulders of the person and also integrates auxiliary expandable storage pockets.

A primary object of the present invention is the provision of a valve apparatus that precludes flow therethrough until the valve plunger thereof is depressed whereupon flow can occur through a closure member thereof.

Another object of the present invention is the provision of a collapsible liquid container that integrates auxiliary expandable storage pockets within a main expandable storage pocket.

Another object of the present invention is the provision of a collapsible liquid container that integrates auxiliary expandable storage pockets within a main expandable storage pocket that collapse into a relatively streamlined system when empty.

Another object of the present invention is the provision of a collapsible liquid container that integrates auxiliary expandable storage pockets and straps for removably securing the container at a location between the shoulders and that has flexible tubing routed from the collapsible container through orienting holders along the shoulder straps in order to conveniently hold the apparatus near the user's mouth without the need to remove the tube from the orienting holders in order to fill the collapsible container with liquid.

Another object of the present invention is the provision of a collapsible liquid container that integrates auxiliary expandable storage pockets and straps for removably securing the container at a location between the shoulders of the user and that has flexible tubing routed from the collapsible container through orienting holders along the shoulder straps and wherein the orienting holders can be easily moved along the straps with one hand in order to adjust the location according to personal preference.

Another object of the present invention is the provision of a collapsible liquid container that employs an embossed foam panel that insulates the liquid and provides air channels to vent and dissipate body heat.

Another object of the present invention is the provision of a collapsible liquid container that integrates auxiliary expandable storage pockets and has an externally accessible fill port for filling the collapsible container with liquid.

Another object of the present invention is the provision of a collapsible liquid container that integrates auxiliary expandable storage pockets and that has an externally accessible fill port covered by a flexible flap which is held in place by the shoulder straps.

Another object of the present invention is the provision of a collapsible liquid container that utilizes shoulder straps for removably securing the container at a location between the user's shoulders and auxiliary expandable storage pockets and has an externally accessible fill port covered by a flexible flap which is held in place by the shoulder straps in such a way that the fill port is held separated from the user's body through the flap because the fill port is held distant from the flap when the straps are pulled tight.

Another object of the present invention is the provision of a collapsible liquid container that has a fill port with multiple support legs on the inner surface such that the opposite flexible wall of the container is held slightly distant from the fill port so that liquid can flow less impeded into the container during the filling operation.

Another object of the present invention is the provision of a valve device adapted to be placed into one's mouth such that one can depress a valve plunger with one's tongue or teeth and open a closure member thereof through which fluid can flow into a person's mouth.

A further object of the present invention is the provision of a supply of liquid carried on one's body and connected to a valve device that can be conveniently and comfortably held within one's mouth and when the valve device is held in one's mouth, liquid flows from the supply into the person's mouth in proportion to the force exerted against the valve plunger of the valve device.

Another object of the present invention is to provide a valve device having an end wall that connects a supply chamber to ambient and a valve plunger located through the end wall with the valve device having a configuration whereby the force exerted against the valve plunger of the valve device determines the rate of flow through the valve body.

An additional object of this invention is to provide a valve device having a valve plunger located through an end wall thereof wherein the pressure exerted against the valve plunger of the valve device determines the movement of a seal away from a sealing surface and the flow rate therethrough.

Another object of this invention is the provision of a valve in the form of an elongated body member that forms a hollow structure having an open inlet end opposed to a closed outlet end, with there being a fluid supply chamber formed between the inlet and outlet ends, and the open end is connected to the end of a length of tubing in order to supply fluid flow to the supply chamber, while the closed end is provided with a closure member that normally precludes fluid flow therethrough and which can be manipulated by the tongue and/or teeth into an opened configuration to enable fluid flow to occur therethrough.

Another object of this invention is to have an orally activated valve device that can be held in one's mouth and in particular one's teeth without activating the valve to allow one to breathe heavily between liquid intake cycles.

Another object of this invention is to have a valve device that makes use of the natural sucking phenomenon whereby one tends to thrust one's tongue forward when sucking on an object.

Another object of this invention is to have an orally activated valve device that does not drip liquid from the valve outlet after closure occurs.

Another object of this invention is to provide a means to securely connect a valve device to tubing and yet still allow the valve device to be purposely disconnected when desired for cleaning or replacement.

Still another object of the present invention is to provide a round, orally-activated valve device that can be held in any position without regard for rotational orientation in one's mouth.

BRIEF DESCRIPTION OF THE DRAWINGS

These and various other objects and advantages of the invention will become readily apparent to those skilled in the art upon reading the following detailed description and by referring to the accompanying drawings, in which.

DETAILED DESCRIPTION OF THE PREFERRED EMBODIMENT

Figure 1:
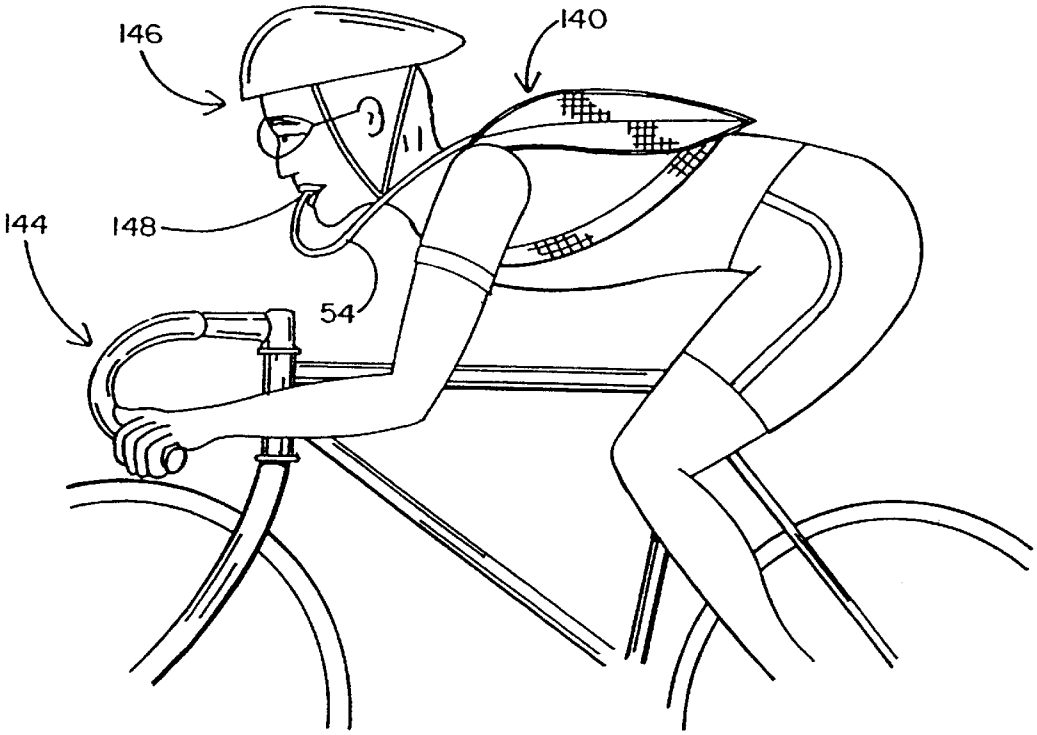
FIG. 1 is a broken, side elevational view of a bicyclist, with the present invention being diagrammatically illustrated therewith.

In FIG. 1 there is shown a bicycle 144 being ridden by a rider or bicyclist 146. The bicyclist has a pack or drinking system 140, made in accordance with the present invention, attached to his back and elevated higher than his mouth 148. A flexible tube 54 leads from the pack 140 to the bicyclist's mouth.

Figure 2:
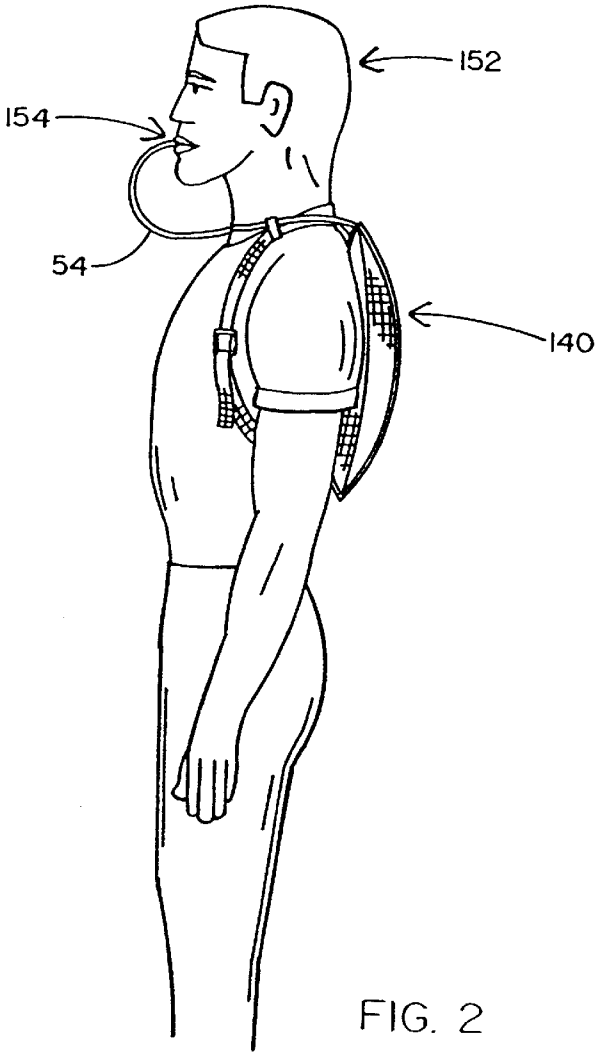
FIG. 2 is a broken, side elevational view of a hiker, with the present invention being diagrammatically illustrated therewith.

In FIG. 2 there is shown a hiker 152 with the pack 140, made in accordance with the present invention, attached to his back and positioned below his mouth 154. A flexible tube 54 leads from the pack 140 to the hiker's mouth.

Figure 3:
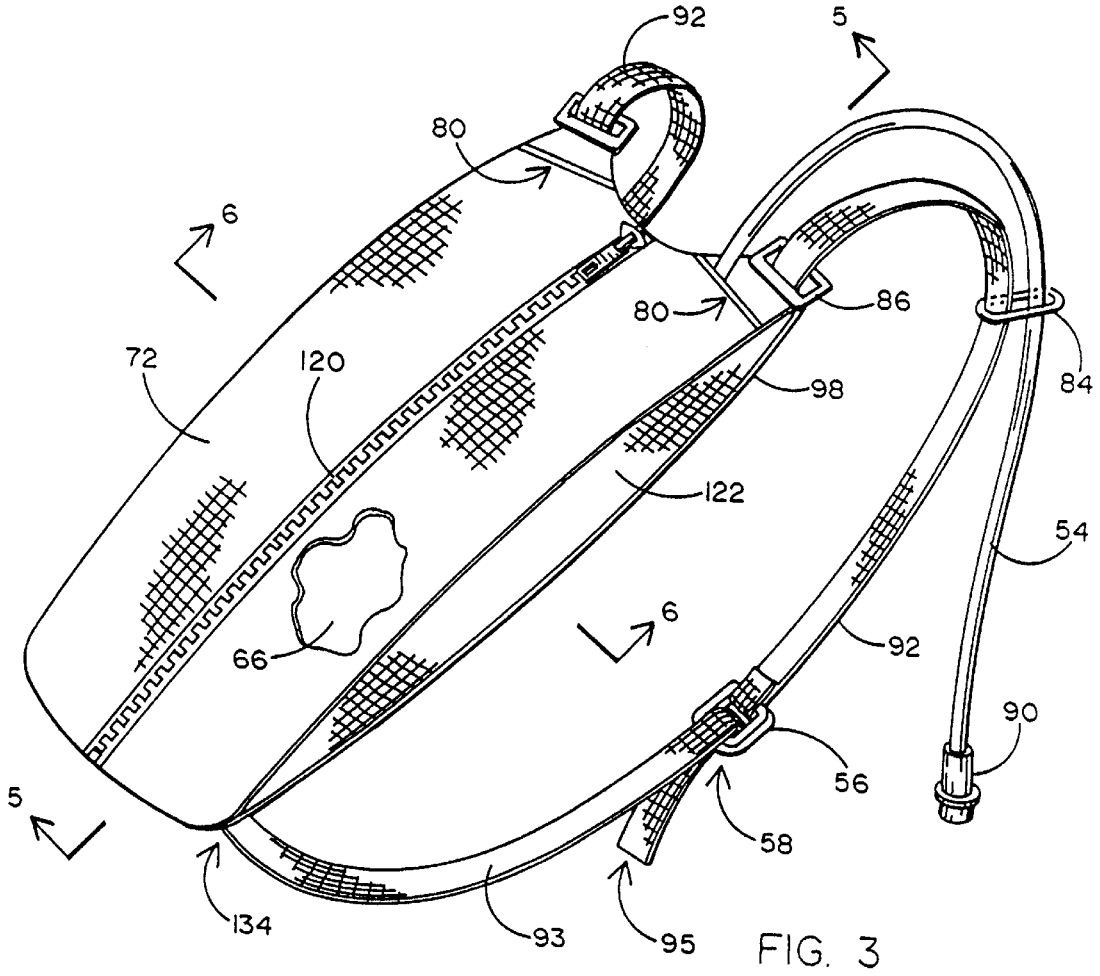
FIG. 3 is a view of the top and side of the drinking system.

In FIG. 3 it is seen that the pack 140 is partially filled with liquid and/or carry items. Items are stored within the drinking system by opening the zipper 120 in the main pocket upper panel 72 and placing the items inside the expandable area 66. A folded gusset panel 122 connects the main pocket upper panel 72 to the rest of the system and allows storage area expansion while allowing the main pocket upper panel 72 to lay substantially flat to the panels beneath when the storage area 66 is empty. Upper straps 92 connect to a fill port flap 98 through slots in the strap guides 86 to ladder lock buckles 56. Lower straps 93 attach to the end of the system 134 and are routed through the ladder lock buckles 56. With the system removably secured at a location between the shoulders of the user to tighten the strap system, the user pulls down on strap end 95. To loosen the strap system, the user pulls up on the ladder lock buckle tip 58.

Tubing 54 exits the bag system through either one of two slot openings 80 in the main pocket upper panel 72 depending on which side the user prefers. The tubing then routes through a tubing guide 84. The tubing guide 84 can be moved to support the tubing 54 at different positions, along the strap 92, depending on the user preference. Finally, the tubing 54 is connected to the orally activated valve apparatus 90.

Figure 4:
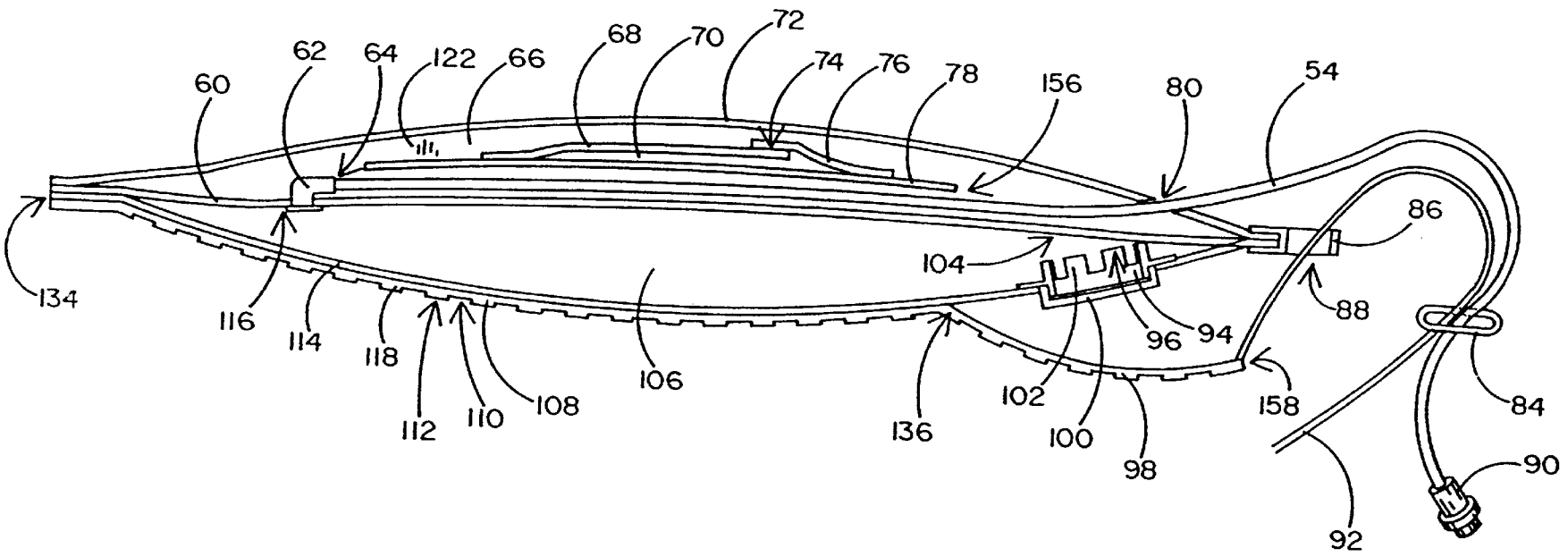
FIG. 4 is longitudinal, cross-sectional view taken along lines 5—5 in FIG. 3.

As shown in FIG. 4, the system comprises an insulating panel 118, a lower bladder panel 114, an upper bladder panel 60, a flexible tube 54, an orally activated valve apparatus 90, straps 92, lower pocket panel 78, upper auxiliary pocket panel and closure flap 68 and 76 respectively, and a main pocket upper panel 72. Liquid is stored within the chamber 106 that is formed of lower bladder panel 114 and upper bladder panel 60. Bladder panels 114 and 60 are connected by heat sealing such as by radio frequency welding or gluing. Bladder panels 114 and 60 are made of materials such as urethane coated nylon packcloth that can seal liquid within. A fill port cap 100 seals against a fill port 94 which is sealed to the lower bladder panel 114 by heat sealing in the same manner as the bladder panels.

During the filling operation, upper surfaces 96 of the legs 102 of the fill port 94 prevent the inner surface 104 of the upper bladder panel 60 from effectively sealing against the port 94 and thus allow liquid to easily enter the chamber 106 relatively unimpeded and without special care required to orient surface 104 away from fill port 94.

While liquid can be purposedly evacuated through the fill port 94 by removing the fill port cap 100 and holding the system upside down, the liquid normally exits chamber 106 via an elbow 62 which is heat sealed to the upper bladder panel 60 at area 116 and is hollow to allow liquid flow therethrough. Tubing 54 is connected to the elbow 62 at area 64 by glue, press fit, or by adding a barbed hollow male/male fitting (not shown) between the elbow 62 and the tubing 54. The tubing 54 is routed between the upper bladder panel 60 and the lower pocket panel 78 and exits the system through a large opening 156 in the lower pocket panel 78 and then through either of two openings 80 depending on user preference, in the main pocket upper panel 72 in line with a shoulder strap 92, as best shown in FIG. 3. The tubing is then routed through a tubing guide 84. Tubing guide 84 can be moved to support the tubing 54 at different positions along the strap 92 depending on user preference. Finally, the tubing 54 is connected to the orally activated valve apparatus 90.

Figure 8:
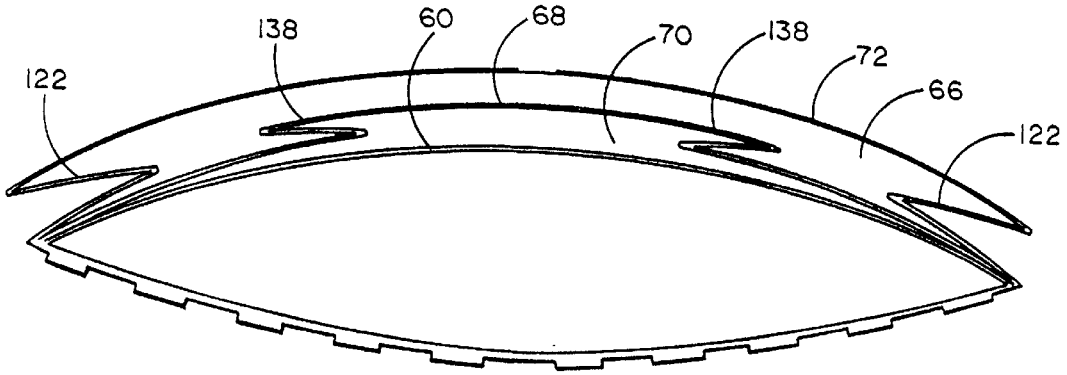
FIG. 8 is a cross-sectional view taken along lines 6—6 in FIG. 3.

The main expandable storage area 66 is created by the upper bladder panel 60, auxiliary pocket panel 68 and closure flap 76, two gusset panels 122 as best shown in FIG. 8, and the main pocket upper panel 72. A zipper 120 provides access to and closure of area 66 as shown in FIG. 3.

An expandable storage area 70 is created by the auxiliary pocket panel 68, closure flap 76, and the lower auxiliary pocket panel 78. Auxiliary panel 68 is folded to allow expansion. The closure flap 76 is secured to the auxiliary pocket panel 68 with a hook and loop fastener 74. The closure flap 76 overlaps the auxiliary pocket panel 68 so that the closure flap 76 can still be fastened to the auxiliary pocket panel 68 with the hook and loop fastener 74 even when area 70 is filled to capacity to a fully expanded state.

An insulating panel 118 is attached to the lower bladder panel 114 from the end 134 of the system to the hinge line 136 and insulates the liquid within a chamber 106 from ambient and the user's body heat. The insulating panel is made of flexible foam laminated on both sides with an abrasion resistant material such as nylon cloth and is embossed to form channels 110 and ribs 108. The surfaces 112 of ribs 108 are in contact with the user's body at a location between the shoulders. The embossed channels 110 allow air to vent between the drinking system and the user's body. The fill port flap 98, which is a continuation of insulating panel 118, hinges along line 136 in order to expose the fill port 94 and fill port cap 100 for filling chamber 106 with liquid. Straps 92 attach to the fill port flap 98 at area 158 and are routed through the strap guide 86 slots 88. The length of the lower bladder panel 114 from hinge point 136 to the end of strap guide 86, which contains the fill port 94, is slightly longer than the fill port flap 98 from hinge point 136 to area 158. When the straps 92 are pulled tight, such as when removably securing the container at a location between the shoulders of the user, the fill port flap 98 is relatively straight against the user's body and the fill port mounted area of the lower bladder panel 114 is forced to curve holding the fill port 94 slightly separated from the backside of the fill port flap panel 98. This prevents uncomfortable point pressure that the fill port cap 100 might otherwise exert against the user's body.

Figure 5:
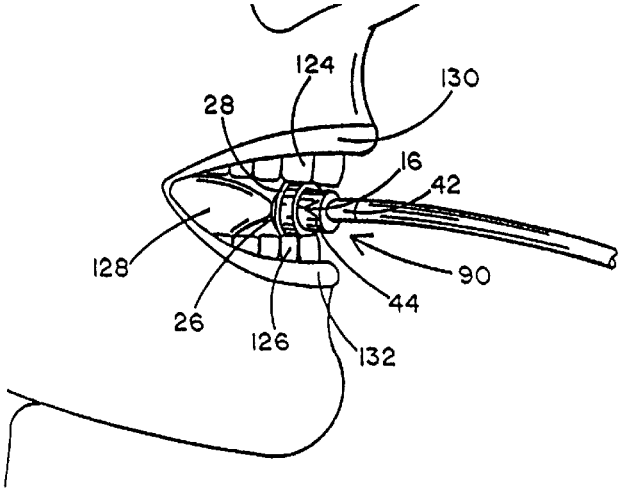
FIG. 5 is a view of a person orally activating the valve apparatus with their tongue.

FIG. 5 shows a person orally activating the valve apparatus with his or her tongue. The user's upper and lower lips, 130 and 132 respectively, are shown distant from the valve apparatus in order to show the activation more clearly. The user is holding the valve apparatus 90 by biting gently with his or her upper and lower teeth, 124 and 126 respectively, on surface 44. To drink, the user would close his or her lips, 130 and 132, around surface 42 or 44 of the valve apparatus 90, and push his or her tongue 128 against the valve plunger 26. Surface 16 of the ring cap 28 prevents the valve apparatus 90 from being pushed out of one's mouth without the need to bite hard on surface 44. Oral suction also generally helps retain the valve apparatus while ingesting the liquid. If the liquid container is at a location higher than the valve apparatus 90, such as in FIG. 1, then hydrostatic pressure will cause liquid to flow without the need for suction. If the liquid container is at a location lower then the valve apparatus 90, such as in FIG. 2, then the user will need to create suction with their mouth in order to ingest the liquid. The person can also hold the valve apparatus 90 between his or her teeth without depressing the valve plunger 26 so that he or she can breathe without activating the valve apparatus.

Figure 6:
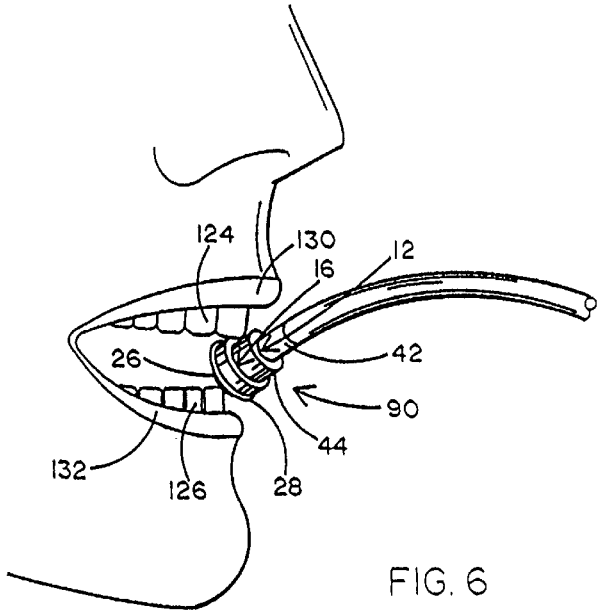
FIG. 6 is a view of a person orally activating the valve apparatus with their teeth.

FIG. 6 shows a person orally activating the valve apparatus with his or her teeth. The user's upper and lower lips, 130 and 132 respectively, are shown distant from the valve apparatus in order to show the activation more clearly. The user is holding the valve apparatus 90 with his or her upper teeth 124 against surface 16 of the ring cap 28 and his or her lower teeth 126 against valve plunger 26. To drink, the user would close his or her lips, 130 and 132, around surface 42 or 44 of the valve apparatus 90, and bite against the valve plunger 26. Surface 16 of the ring cap 28 and lip pressure against surfaces 42, 12, 44 and/or 16 prevent the valve apparatus 90 from being pushed out of one's mouth. Oral suction also generally helps retain the valve apparatus while ingesting the liquid. If the liquid container is at a location higher than the valve apparatus 90, then hydrostatic pressure will cause liquid to flow without the need for suction. If the liquid container is at a location lower then the valve apparatus 90, then the user will need to create suction with his or her mouth in order to ingest the liquid.

Figure 7:
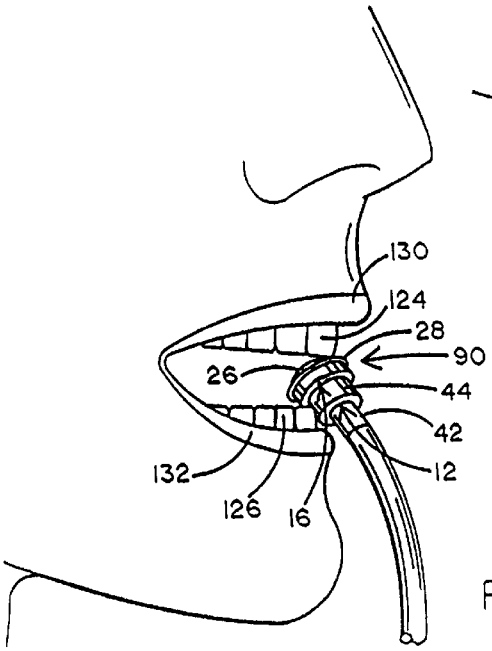
FIG. 7 is a view of a person orally activating the valve apparatus with their teeth in a different manner than in FIG. 6.

FIG. 7 shows a person orally activating the valve apparatus with his or her teeth in a manner different than in FIG. 6. The user's upper and lower lips, 130 and 132 respectively, are shown distant from the valve apparatus in order to show the activation more clearly. The user is holding the valve apparatus 90 with his or her lower teeth 126 against surface 16 of the ring cap 28 and his or her upper teeth 124 against valve plunger 26. To drink, the user would close his or her lips, 130 and 132, around surface 42 or 44 of the valve apparatus 90, and bite against the valve plunger 26. Surface 16 of the ring cap 28 and lip pressure against surfaces 42, 12, 44 and/or 16 prevent the valve apparatus 90 from being pushed out of one's mouth. Oral suction also generally helps retain the valve apparatus while ingesting the liquid. If the liquid container is at a location higher than the valve apparatus 90, then hydrostatic pressure will cause liquid to flow without the need for suction. If the liquid container is at a location lower then the valve apparatus 90, then the user will need to create suction with his or her mouth in order to ingest the liquid.

In FIG. 8, the valve shown is a cross-sectional view looking in the direction of lines 6—6 in FIG. 3. Gusset panels 122 attach the upper bladder panel 60 to the main pocket upper panel 72. Because of the fold in gusset panel 122, the main pocket upper panel 72 is free to move away from the upper bladder panel 60 to accommodate stored items within the main pocket storage area 66 and the auxiliary pocket storage area 70. Similarly folds 138 within the upper auxiliary pocket panel 68 act as gussets to expand when items are stored within area 70. Gussets 122 and folds 138 also freely collapse to provide a relatively streamlined system when area 66 and/or 70 are empty.

Figure 9:
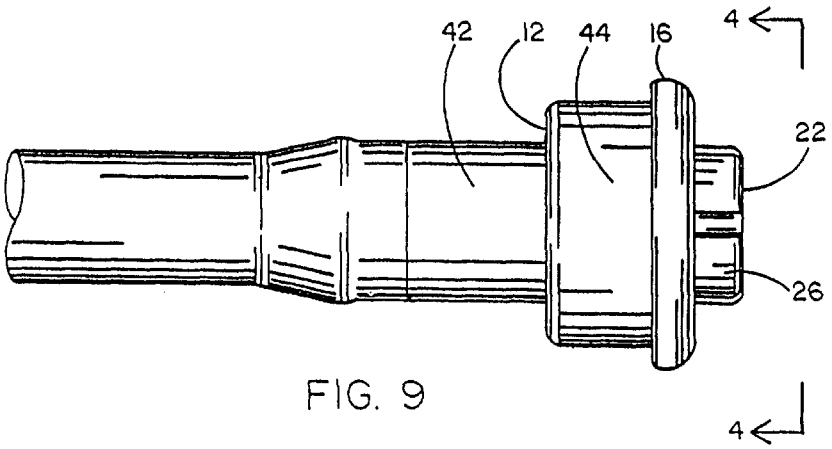
FIG. 9 is a longitudinal view with the valve in the normally closed position.

In FIG. 9, the valve is shown in a longitudinal view in the normally closed position. The user can hold the valve within his or her mouth by holding surfaces 42 and 44 between the teeth or lips. Surfaces 12 and 16 prevent the valve from slipping out of the user's mouth without having to apply large force against surfaces 42 or 44. By pushing against the valve plunger 26 on surface 22 with his or her tongue or teeth, the user orally opens the valve.

Figure 10:
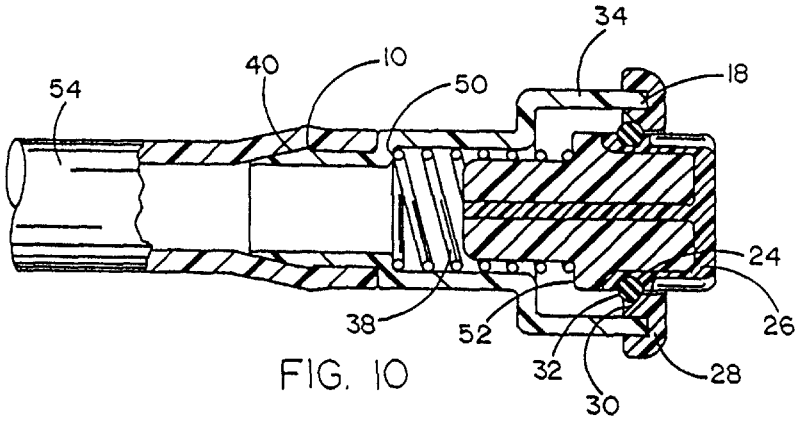
FIG. 10 is a longitudinal, cross-sectional view taken along lines 3—3 in FIG. 12 with the valve in the normally close position.

In FIG. 10, the valve is shown in a longitudinal, cross-sectional view in the normally closed position. Flexible tubing 54 has been pushed onto the barbed portion of valve body 34 and is secured in place by the barb 10. The angled surface 40 of the valve body 34 allows easy installation of the flexible tube 54 while the barb 10 prevents accidental separation and still allows purposeful separation for cleaning or replacement, if necessary.

The ring cap 28 is bonded to the valve body 34 at attachment area 18 by glue, ultrasonic welding, screw threads, tight press fit or other appropriate means which both seals the parts together and prevents separation. Inside this ring cap 28 and valve body 34 there are a valve plunger 26, an O-ring 32, and a compression spring 38. The O-ring 32 seals against surface 24 of the valve plunger 26 and is biased into a closed position against sealing surface 30 of the ring cap 28 by the compression spring 38 and hydrostatic pressure that is present if the liquid container is higher than the valve apparatus 90. The ends of compression spring 38 are held in position at one end by the valve body surface 50 and at the other end by the valve plunger surface 52.

Figure 11:
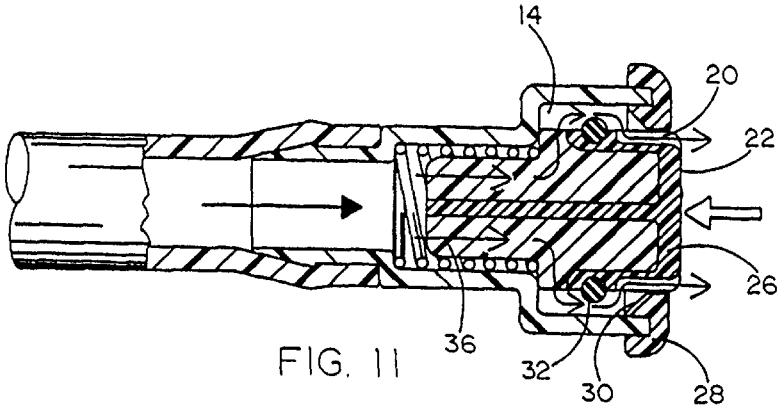
FIG. 11 is another longitudinal, cross-sectional view taken along lines 3—3 in FIG. 12 with the valve being in the open position.

In FIG. 11, the valve is shown with enough force applied to the valve plunger 26 on surface 22 to overcome the force applied from the compression spring 38 and any hydrostatic pressure causing the valve plunger 26 to have moved such that the O-ring 32 is no longer in contact with the ring cap surface 30. This plunger position connects the valve chamber 14 to ambient and allows liquid within the valve chamber 14 to flow down the tube, along the valve plunger ribs 36, around the O-ring 32 and out through the flow channel 20. Each flow channel 20 is sufficiently small in cross-section to prevent liquid from dripping from the valve after valve closure occurs. In the preferred embodiment, in order to obtain the maximum flow that the tube can provide, all of the areas within the valve assembly that the liquid passes through, should be sized such that they are equal to or bigger than the flow area of the tube. The valve plunger 26 is aligned to the spring 38 by the multiple ribs 36 of the valve plunger 26 close proximity to compression spring 38 internal diameter. The compression spring 38 is aligned to the valve body 26 by the outer diameter of the compression spring 38 close proximity to the internal diameter of the valve body 34.

Figure 12:
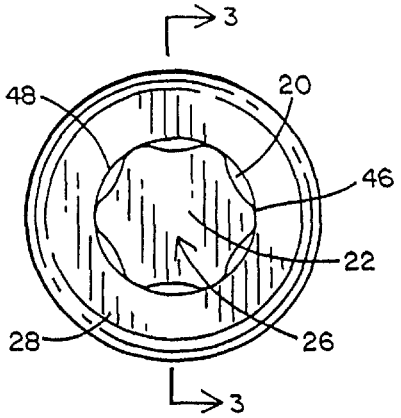
FIG. 12 is an end view of the apparatus disclosed in FIGS. 9, 10 and 11 taken along lines 4—4 in FIG. 9.

In FIG. 12, the valve is shown in an end view. The multiple surfaces 46 of the valve plunger 26 align the valve plunger 26 to the ring cap 28 while the flow channels 20 allow liquid to flow through with minimal restriction. To achieve maximum flow, the total area between the valve plunger 26 and the ring cap 28 should be equal to or greater than the flow area of the tube 54 shown in FIG. 10. The surface 22 of the valve plunger 26 is free of distortions and sharp areas that could cause discomfort against the user's tongue. The valve plunger 26 is aligned to the ring cap 28 by alignment surface 46 close proximity to the ring cap 28 opening diameter 48. The generally round shape of the ring cap 28, the valve plunger 26 and the valve body 34, allow use of the valve apparatus 90 without regard for rotational orientation.

Having thus disclosed a preferred, illustrative embodiment of the present invention, the structure, operation and general principles thereof now being readily apparent, we claim:

1. An orally activated valve for use with a liquid delivery system to which the valve is connected by a tube, the valve comprising:

a hard, elongated housing having an inlet located at a first end of said housing and a plurality of short outlets located at a second end of said housing and a flow path extending in an axial direction therebetween, the inlet being connected to said tube, the outlets having a spring biased sealing device therein for selective opening of said outlets, an annular ring cap attached to an outer periphery of the housing second end, the annular ring cap being configured for oral retention in the mouth of the user, the sealing device being a plunger, said plunger having an outer peripheral wall engaging said ring cap for limiting plunger movement to the axial direction for unsealing the outlets in response to an axial depression force by the tongue of the user whereby a liquid flows directly from said inlet to said outlets, said plunger being axially biased contiguous said housing for fluidly blocking said plurality of short outlets when said depression force is removed;

said movable plunger extending beyond said housing second end for ease of access by the tongue of the user.

2. The valve recited in claim 1 wherein said housing is configured for retention between the user's teeth without activation.

* * * * *